United States Patent [19]

Lacey

[11] Patent Number: 5,011,025

[45] Date of Patent: Apr. 30, 1991

[54] FEEDER FOR SEED CLEANER

[76] Inventor: Edward H. Lacey, P.O. Box 796, Trent, S. Dak. 57065

[21] Appl. No.: 435,597

[22] Filed: Nov. 13, 1989

[51] Int. Cl.[5] ..... B07B 13/16

[52] U.S. Cl. ..... 209/618; 209/673; 209/911

[58] Field of Search ..... 209/618, 673, 667–669, 209/910, 911, 920; 198/534; 222/556, 558

[56] References Cited

U.S. PATENT DOCUMENTS

| | | | |
|---|---|---|---|
| 472,299 | 4/1892 | Knapp | 209/910 X |
| 515,776 | 3/1894 | Knapp | 209/618 |
| 1,148,589 | 8/1915 | Johnson | 209/618 |
| 1,459,553 | 6/1923 | Rocheleau | 209/910 X |
| 1,461,265 | 7/1923 | Bullard | 209/669 X |
| 1,489,524 | 4/1924 | Ginter | 209/911 X |
| 1,712,838 | 5/1929 | Nickle | 209/618 |
| 2,343,042 | 2/1944 | Barry | 209/668 |
| 2,915,180 | 12/1950 | Mac Gillivray | 209/911 X |
| 3,661,257 | 5/1972 | Hall et al. | 209/920 X |

*Primary Examiner*—Michael S. Huppert
*Assistant Examiner*—Edward M. Wacyra

[57] ABSTRACT

A feeding mechanism adpated to feed seeds such as soybeans, navy or pinto beans into a cleaning device. The feeder includes a hopper which is supplied by a hose from a large bin, and which, in turn, feeds a spout emptying into an adjustable chute which forms a metering device. The slope of the chute is adjustable to control the rate of flow of the seeds into the cleaner.

5 Claims, 2 Drawing Sheets

FEEDER FOR SEED CLEANERBACKGROUND AND SUMMARY OF THE INVENTION

This invention pertains to devices for cleaning seeds of legumes such as soybeans, navy beans or pinto beans and the like and more particularly to a feeding device adapted to control the rate at which the seeds are fed into the cleaner.

Soybeans and similar legumes are now relatively important crops for commercial farmers. For proper planting, it is important that seeds be planted only if they are near perfect. Chaff, cracked seeds and other impurities should be eliminated before planting. Therefore, cleaning machines such as the one shown in my previous application, Ser. No. 06/526,362, filed Aug. 25, 1983, and now abandoned, have been proposed. These machines use pairs of rollers rolling against each other similar to the wringers on washing machines of the 1930's. Proper hardness (or softness) of the rollers, or at least one of them, provides that whole bean seeds are delivered from the rollers only if they are uncracked, and not flawed by having cracked or musty coats.

One of the problems limiting such machines is the rate of feed to the rollers. Some machanisms use a positive feed consisting of rotating sockets, each of which picks up a single seed and delivers it to the rollers. This type of feed may work at slower speeds, but it requires a relatively complex mechanism. Furthermore, it will not properly handle beans which are not fully dried. Moist beans simply are chewed into a paste in such machines.

Other feeds may use a completely gravity feed to deliver beans down a chute directly onto the rollers. My invention pertains to such devices but cures the problem of difficulty of control as to the speed of delivery. If this older type of gravity feeder is used for multiple pairs of rolls, the feed may be properly adjusted for one pair of rolls and be maladjusted for another.

By my invention, I provide individual feeders for each set of rollers. Each of the feeders is fully and finely adjustable to provide for different rates of flow. Such adjustment will allow the flow of one bean at a time to flow down the chute. The variable in such flow is the interval between the beans. In addition to being metered for flow rates, my device can be used on machines having multiple pairs of rollers to feed either large quantities of the same seed, or possibly more than one type of seed for cleaning on the same machine. Once that rate is set on each feeder, the beans will continue to flow at that rate until a bean of substantially different size is used. If that happens, then the entire machine will require re-setting.

If more than one type of seed is being cleaned, separate adjustments and separate supply sources as well as a separate delivery system of the seed will be required for each type of seed. A common place of disposition of the rejected material going through the rolls may be used. My new feeder is very effective in controlling rates of flow, and when the rate is well controlled, it is effective in removing foreign material such as stones and even other grains such as corn.

DESCRIPTION

Figure 1:
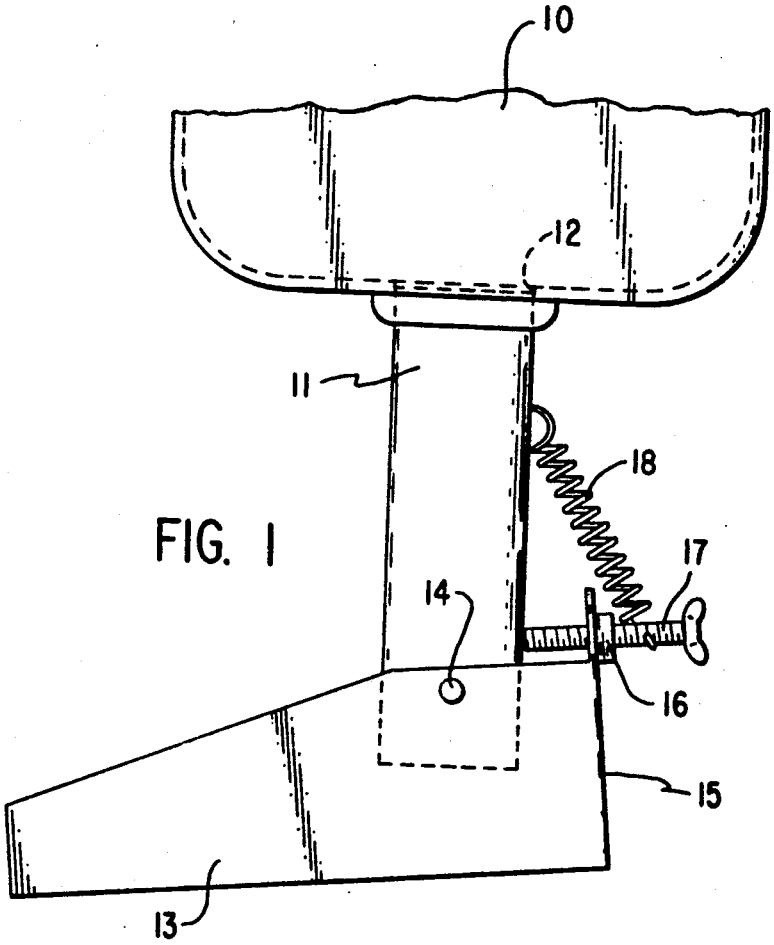
FIG. 1 is a side elevational view of the feeder of my invention.
Figure 3:
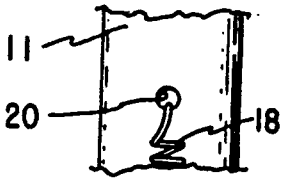
FIG. 3 is a detailed view of a part of the spout showing an attachment of the spring which positions the chute.
Figure 2:
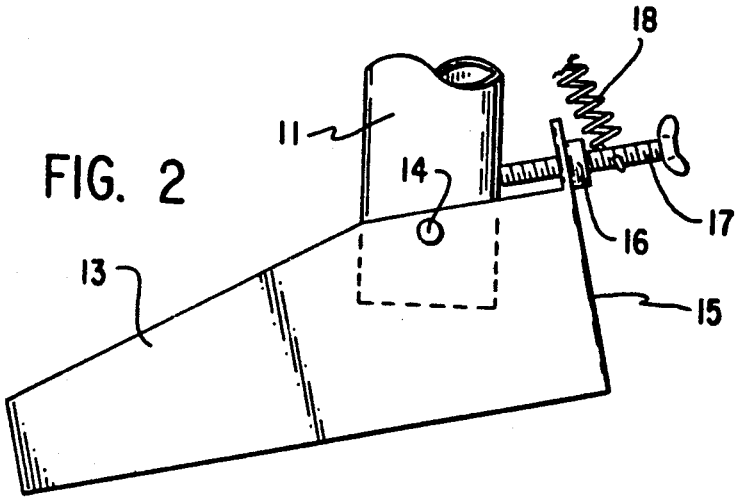
FIG. 2 is a partial view of the device of FIG. 1 showing the chute at a different adjusted position.

Briefly my invention comprises a feeding device adapted to provide a controlled adjustable feed for a seed cleaner. The device includes a spout feeding an adjustable chute to control the rate at which the seeds are discharged to the rolls of the cleaner.

More specifically and referring to the drawings, my invention in its first embodiment includes a hopper 10 adapted to be supported above the rolls 9 of the seed cleaner. It may be supported on the frame of the cleaner or from an adjacent stand. In the original, an individual hopper for each pair of rolls was used. However, it will be obvious from the following description of the alternative embodiment that a single hopper which may be compartmentalized or even a single open hopper could be used.

A spout 11 for each pair of rolls leads downward from the hopper. This spout must be of a size adequate to accommodate a substantial flow of seeds and is not to be limited to feeding a single seed. The basic consideration is that there be no bridging over of the entrance 12 to the spout 11. Further avoidance of that problem should be accomplished by use of a vibrator mechanism attached to the frame from which the spout is suspended. Because this use of vibrators for this purpose is well-known in the art, there is no illustration thereof in this embodiment.

A metering chute 13 is pivotally fastened to the bottom of the spout 11 by rivets 14 or the like. Thus the chute 13 can be tilted to a greater or lesser angle to horizontal. Such tilting will provide a greater or lesser incline down which the seeds must roll to the end of the chute and therefore the tilting will regulate the speed at which seeds are delivered to the rolls.

Control of the angle of the chute 13 is accomplished by the use of a spring and screw mechanism. The chute 13 is formed with an extended back 15 on which a boss 16 is fixed. A thumb screw 17 is threaded into the boss 16 and is adapted to engage the outer wall of the spout 11. It will be obvious that a pad or other reinforcement for the spout 11 at the point of contact may be used if it is deemed necessary.

Figure 4:
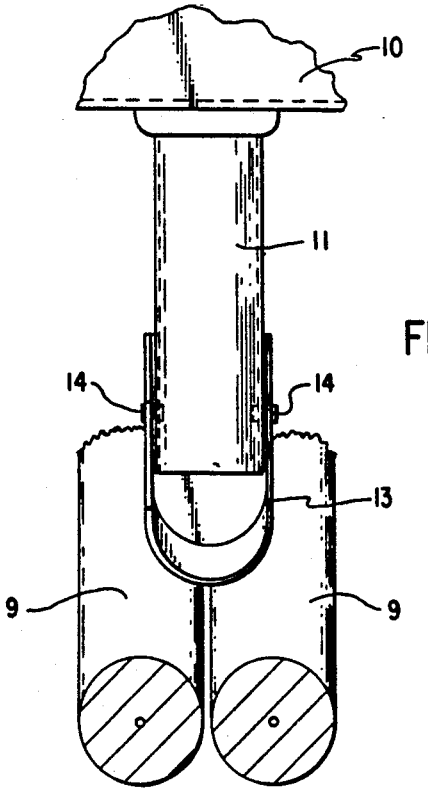
FIG. 4 is an end elevational view of the device of FIG. 1.

A tension spring 18 may be engaged between the spout 11 and the screw 17 to hold the screw 17 engaged with the spout 11 or the pad if one is used. The mode of connection of the spring 18 may be varied. I envision the use of attachment means such as sheet metal ears, as a possibility. However, the spring works well when attached to a hole 20 in the wall of the spout 11 (FIG. 4) at one end and looped around the screw 17 at the other end. Thus, tension in the spring 18 will tend to pull the chute 13 in a direction to press the end of the screw 17 against the spout 11. Tightening the screw 17 will then tend to flatten the angle of the chute 13 thus adjusting its slope.

In use, the bean (or other) seed will flow through the spout 11 until a pile of seed fills the chute 13 to the end of the spout. To make certain the spout properly delivers the seed, a vibrator should be used to agitate the hopper 10. At that point, the seed will no longer flow through the spout 11. Tilting the chute downward away from the spout will allow the seeds to roll down the chute, and decrease the pile so that more will flow from the hopper. By adjusting the slope of the chute, the rate of flow can thus be controlled.

Figure 5:
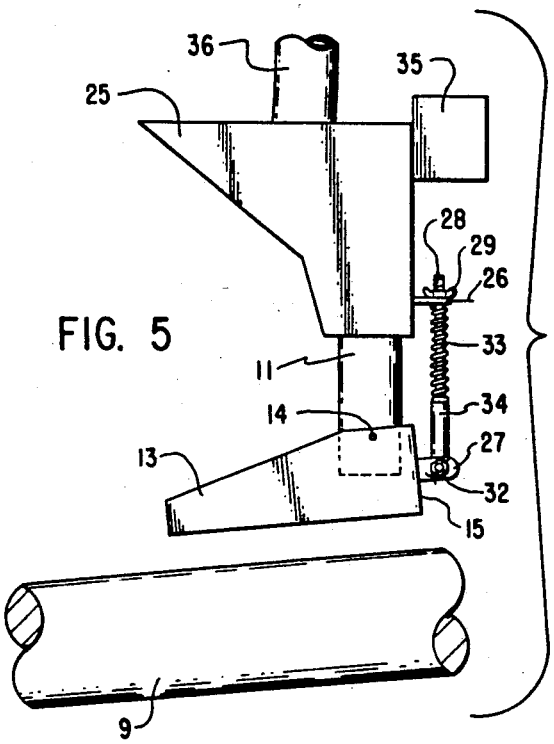
FIG. 5 is a side elevational view similar to FIG. 1 of an alternative embodiment.
Figure 6:
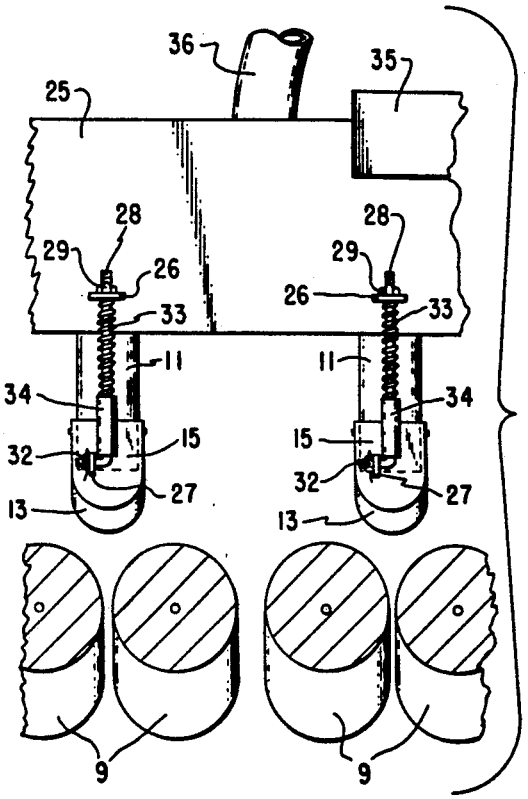
FIG. 6 is a rear elevational view of the embodiment of FIG. 5.

In FIGS. 5 and 6, I illustrate an alternative machine using a single supply hopper 25 with multiple spouts 11 feeding a plurality of pairs of rolls 9. The chute 13 is pivotted to the spout 11 by rivets 14 in the same manner as in the previously described embodiment. However, the means for tilting the chute is somewhat different.

In this embidiment, a horizontally oriented ear 26 is formed on the hopper 25. A vertically oriented ear 27 is formed in the back 15 of the chute 13. An L-shaped bolt 28 is pivotally journalled in the ear 27 and includes a threaded end extending through the ear 26. A thumb-nut 29 is threaded onto this part of the bolt 28. The opposite end of the bolt is secured in the ear 27 by means of a head 32. Surrounding the bolt 28 are a compression spring 33 and a sleeve 34. The sleeve 34 abuts the bent part of the L-shaped bolt 28 and thus provides a seat against which the spring 33 may press. In the alternative, a washer could be fixed to the bolt to provide a similar seat. The opposite end of the spring abuts the ear 26. Thus the spring 33 is compressed between the ear 26 and the sleeve 34 tending to press downward on the bolt 28.

It will again be apparent that adjusting the nut 29 will move the bolt 28 against the spring 33 or will allow the spring to move the bolt downwardly, thus moving the ear 27 and adjustably tilting the chute 13. In this embodiment any conventional vibrator 35 may be attached to the hopper 25, and one or more hoses 36 may feed into the hopper from a storage bin (not shown). Tests indicate that a single vibrator will provide sufficient agitation for a single hopper feeding a bank of fifteen of the metering sprouts. It is preferable, when using a single vibrator to use a fiber thumb-nut so that the agitation does not cause the nut to turn and allow the metering spouts to change their adjusted position.

In either embodiment, both the function of the spout 11 in emptying a supply of seeds onto the chute 13 and the function of the chute in delivering the seeds to the roller 9 is the same. The tilting of the chute is caused by slightly different means, yet in both cases, the tilting is adjusted by screw means acting in opposition to the urging of a spring.

I claim:

1. For use with a seed cleaning machine having at least one pair of cleaning rollers, a feeding device comprising hopper means, a spout extending from said hopper means above each said pair of rollers, and chute means including a chute movably mounted on said spout adapted to receive seed from said hopper means through said spout for delivery to said rollers, screw means threadably engaged with said chute and adapted to engage said spout and a spring engaged between said spout and said chute means to bias said screw means into engagement with said spout.

2. The feeding device of claim 1 in which said screw means includes finger engagement means by which said screw means can be manually operated.

3. For use with a seed cleaning machine having at least one pair of cleaning rollers, a feeding device comprising hopper means, a spout extending from said hopper means above each pair of rollers, said hopper means and said spout together forming a fixed portion, chute means including a chute mounted on said spout adapted to receive seed from said hopper means through said spout for delivery to said pair of rollers, screw means threadably engaged with said chute means and adapted to engage said spout and a spring engaged between said fixed portion and said chute means to bias said screw means into engagement with spout.

4. For use with a seed cleaning machine having at least one pair of cleaning rollers, a feeding device comprising hopper means, a spout extending from said hopper means above each pair of rollers, chute means including a chute movably mounted on said spout adapted to receive seed from said hopper means through said spout for delivery to said pair of rollers, screw means threadably engaged with said chute means and adapted to engage said spout, and a compression spring engaged between said chute means and said spout to urge said chute to a bias tilted position, said screw means being adjustable to cause said chute to move to a more tilt position.

5. The feeding device of claim 4 in which said screw means includes an L-shaped bolt engaged between an ear on said spout and an ear on said chute, a sleeve surrounding a part of said bolt, said spring engaged between said sleeve and said ear on said spout, and thumb-nut means on said bolt adapted to pull said ear on said chute against the pressure of said spring.

* * * * *